US009192544B2

(12) United States Patent
Wang

(10) Patent No.: US 9,192,544 B2
(45) Date of Patent: Nov. 24, 2015

(54) FEEDING BOTTLE CAPABLE OF PREVENTING NIPPLE FROM FALLING OUT AND WITH AIR RETURN FUNCTION

(71) Applicant: DONGGUAN YINYAN PLASTIC CONTAINERS CO., LTD, Dongguan, Guangdong (CN)

(72) Inventor: Zhujin Wang, Guangdong (CN)

(73) Assignee: DONGGUAN YINYAN PLASTIC CONTAINERS CO., LTD, Dongguan (CN)

( * ) Notice: Subject to any disclaimer, the term of this patent is extended or adjusted under 35 U.S.C. 154(b) by 0 days.

(21) Appl. No.: 14/155,381

(22) Filed: Jan. 15, 2014

(65) Prior Publication Data

US 2014/0224758 A1 Aug. 14, 2014

(30) Foreign Application Priority Data

Jan. 16, 2013 (CN) ..... 2013 1 0016863

(51) Int. Cl.

| | |
|---|---|
| ***A61J 9/04*** | (2006.01) |
| ***A61J 11/02*** | (2006.01) |
| *A61J 11/04* | (2006.01) |

(52) U.S. Cl.

CPC .. *A61J 11/02* (2013.01); *A61J 9/04* (2013.01); *A61J 11/04* (2013.01)

(58) Field of Classification Search

CPC ..... A61J 9/04; A61J 11/02
USPC ..... 215/11.5, 11.1–11.4, 11.6
See application file for complete search history.

(56) References Cited

U.S. PATENT DOCUMENTS

| | | | | |
|---|---|---|---|---|
| 2,426,927 | A * | 9/1947 | Ganson | 215/11.5 |
| 2,597,483 | A * | 5/1952 | Head, Sr. | 137/533.29 |
| 2,767,871 | A * | 10/1956 | Shapiro | 215/11.5 |
| 2,959,314 | A * | 11/1960 | Sanchez | 215/11.1 |
| 5,791,503 | A * | 8/1998 | Lyons | 215/11.5 |
| 2010/0314347 | A1* | 12/2010 | Haberman et al. | 215/6 |

FOREIGN PATENT DOCUMENTS

CN 2180256 Y 10/1994

* cited by examiner

*Primary Examiner* — Jeffrey Allen
*Assistant Examiner* — Jennifer Castriotta

(57) ABSTRACT

A feeding bottle preventing a nipple from falling out and with an air return function including a nipple body and a bottle body, the feeding bottle further includes an air inlet plate, a capping and a fitting ring, and the air inlet plate is fixed between the nipple body and the bottle body by the capping. The present application can prevent the nipple from falling out, prevent leakage caused by drawing out of the nipple when baby is sucking and even falling out, and achieve the automatic air return.

7 Claims, 4 Drawing Sheets

FEEDING BOTTLE CAPABLE OF PREVENTING NIPPLE FROM FALLING OUT AND WITH AIR RETURN FUNCTION

CROSS-REFERENCE TO RELATED APPLICATIONS

This present application claims the benefit of Chinese Patent Application No. 201310016863.3 filed on Jan. 16, 2013; the contents of which are hereby incorporated by reference.

FIELD OF THE INVENTION

The present application relates to the feeding bottle field, and particularly to a feeding bottle preventing a nipple from falling out and with an air return function.

BACKGROUND OF THE INVENTION

The feeding bottle used for feeding a baby on the current market has following questions in general.

For the existing common feeding bottle, the nipple body is directly connected with the bottle body, and no special device is arranged between the nipple body and the bottle body. Since the nipple is made of soft material, in the process of user feeding baby or child with milk, if the baby or child is naughtier and bites the nipple without releasing it, as long as the user applies force a little harder, the nipple will be drawn out from the feeding bottle, thus causing inconvenience to user.

Furthermore, for the feeding bottle available on the current market, in the process of using it to feed baby or child with milk, there is a drawback that air return can not be achieved. Therefore, with the reduction of the milk in the feeding bottle, a negative pressure will be formed in the feeding bottle, and the feeding bottle and the nipple may be recessed or flattened, resulting in difficulty in drinking for baby, if terrible, may choke the vulnerable trachea of baby. If drawing the nipple out of the mouth of baby to return air for the feeding bottle while the baby is drinking, the baby will often cry and scream, thus affecting the health of baby.

For some feeding bottles, a ventilating hole is provided on the feeding bottle or the nipple, actually, returning air smoothly can not be achieved in this way. At present, a feeding bottle preventing a nipple from falling out and with an air return function is available, for example Chinese patent NO. ZL94202689.6 titled "AIR RETURN BY STRAIGHT SUCTION TYPE FEEDING BOTTLE", which performs air return by employing a U-shaped tube, although the air return effect can be achieved, the structure of which is too complex, the cost of manufacture of which is high, and which is difficult to clean, thus bringing hidden danger to the health of baby.

For some improved feeding bottles, to enable the nipple body being not easy to fall out from the bottle body, the connecting component for connecting the bottle body and the nipple body with each other is directly solidified on the nipple body, as will be readily seen, the disadvantage of such design is in that the nipple body is difficult to clean, the applicability of the nipple body is weak, and the cost of production is high.

SUMMARY OF THE INVENTION

The technical problem to be solved by the present application is to provide a feeding bottle preventing a nipple from falling out and with an air return function, in the process of baby or child sucking the feeding bottle, the nipple will not fall off, and the feeding bottle itself can achieve the automatic air return, the structure of which is simple, the cost of production of which is low, and which is easy to clean.

In order to achieve the above objects, the present application provides the following technical solutions.

A feeding bottle preventing a nipple from falling out and with an air return function including a nipple body and a bottle body, wherein the feeding bottle further includes an air inlet plate and a capping, and the air inlet plate is fixed between the nipple body and the bottle body by the capping.

Furthermore, the air inlet plate is provided with a pressing ring, and the pressing ring presses against an inner wall of the nipple body.

Furthermore, the air inlet plate is provided with a retaining ring on the side close to the bottle body, and the outer diameter of the retaining ring is equal to the inner diameter of an opening portion of the feeding bottle.

Furthermore, the air inlet plate is provided with a retaining ring on the side close to the bottle body, and the outer diameter of the retaining ring is less than the inner diameter of a opening portion of the feeding bottle.

Furthermore, the air inlet plate is generally of a ring shape, the air inlet plate is further provided with a ventilating hole and a ventilating groove, and the ventilating hole and the ventilating groove are communicated with each other.

Furthermore, the feeding bottle further includes a fitting ring, wherein the fitting ring is embedded in the air inlet plate, the ventilating groove of the air inlet plate and a contacting surface of the nipple body cooperate with each other and form a unidirectional air inlet passage, and the air inlet plate and the fitting ring are fitted together so that a closing cap covers the ventilating hole so as to form a closed air return space.

Furthermore, the fitting ring is of a ring shape, an outer portion of the fitting ring has a deformable closing cap, and the closing cap has a sealing effect.

Furthermore, an inner portion of the fitting ring is provided with a neck portion, and the air inlet plate is sleeved outside the neck portion.

Furthermore, an end of the neck portion that closes to the nipple is provided with a ring shaped snap portion being able to snap the air inlet plate.

Furthermore, the outer portion of the fitting ring is further provided with a ring shaped air dispersing cap, the air dispersing cap is provided with air dispersing holes, and the air dispersing cap, the closing cap, and the bottle body enclose an air dispersing space.

The present application is provided with the air inlet plate, that is a fixing and connecting component is further provided between the nipple body and the bottle body, the nipple body and the bottle body have the fixing and connecting component not only at the outer walls but also at the inner walls, they are fixed and connected in two directions from the outer walls and the inner walls, so that the nipple body can be steadily connected to the bottle body. Moreover, the present application is further provided with the fitting ring, the air inlet plate and the fitting ring cooperate with each other, in the process of baby sucking out milk, the milk will flows out from the nipple and a negative pressure will be generated inside the feeding bottle, thereby, the outside atmosphere sequentially passes through the ventilating groove and the ventilating hole, reaches to the air return space, and then goes into the feeding bottle through the gaps formed by fitting the air inlet plate and the fitting ring together, thus achieving air return. When the milk is not sucked out by the baby, if the feeding bottle is placed upside down, since there is no negative pressure inside the feeding bottle, the air pressure inside the feeding bottle is sufficient to tightly close the air inlet plate and the fitting ring, thus the milk will not leak out from the ventilating hole.

As compared with the prior art, the present application not only can prevent the nipple body from falling out from the bottle body, but also can achieve the effect of automatic air return, the structure of which is simple, the air return effect is better, and the air inlet plate and the fitting ring functioning to air return are easy to clean after being disassembled. Furthermore, for existing common feeding bottle, the air inlet plate and the fitting ring according to the present application can be conveniently mounted thereon so as to be converted into a feeding bottle that can achieve air return, thus improving the utilization of raw material and achieving economy and environmental protection effect.

BRIEF DESCRIPTION OF THE DRAWINGS

In order to illustrate embodiments of the present application or technical solutions in the prior art more clearly, drawings required in the descriptions of the embodiments or the prior art will be described briefly hereinafter, obviously, the drawings in the following description are only some embodiments of the present application, and those skilled in the art can also obtain other drawings from these drawings without any creative work.

DETAILED DESCRIPTION OF THE INVENTION

In order to make the object, technical solutions and advantages of the present application more clearly, technical solutions in the embodiments of the present application will be described hereinafter clearly and completely in conjunction with the accompanying drawings and the embodiments of the present application. It should be noted that the embodiments are only a part of the embodiments of the present application, rather than all embodiments. All other embodiments obtained based on the embodiments in the present application by those skilled in the art without any creative work should be considered as falling into the scope of protection of the present application.

Figure 1:
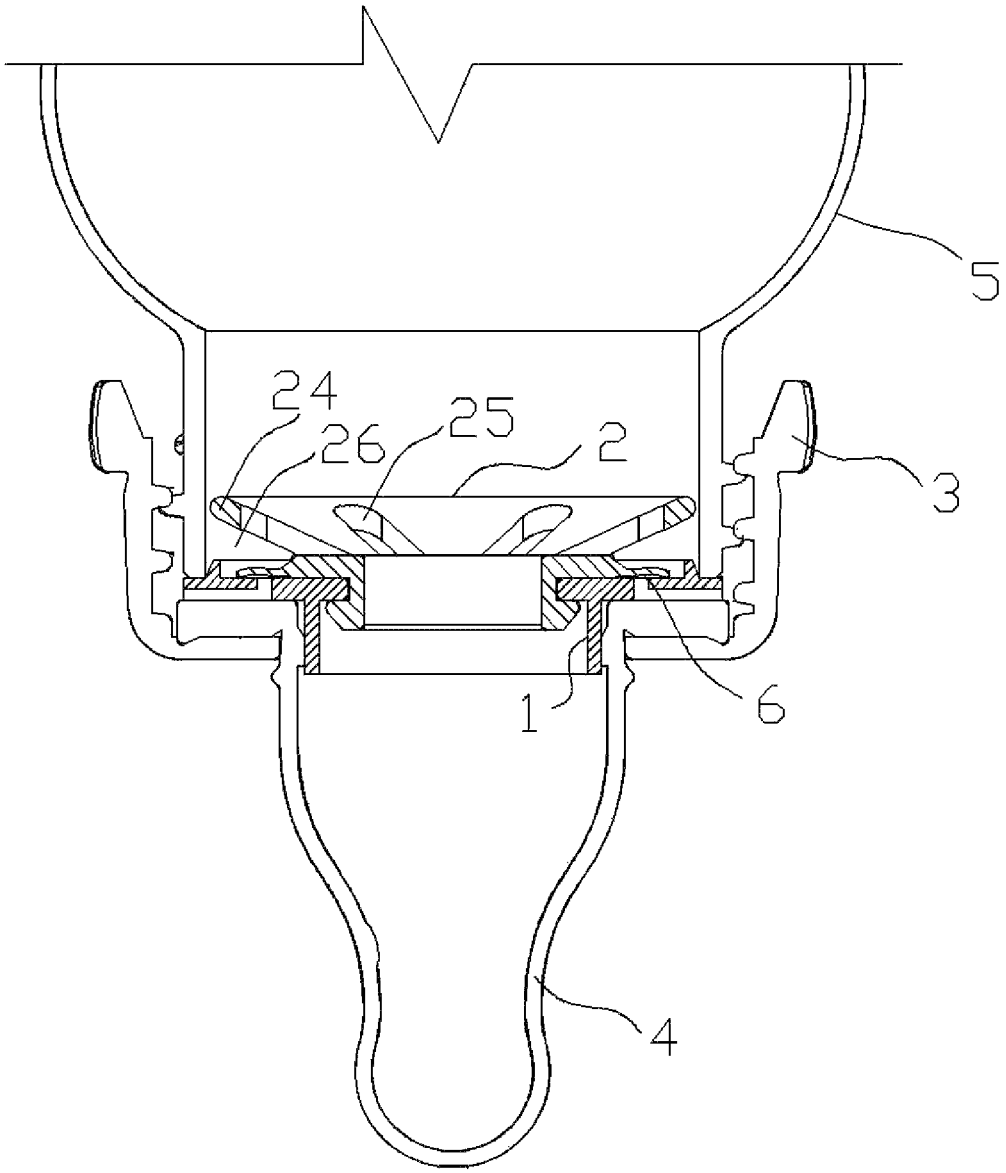
FIG. 1 is a assembling schematic view with an embodiment according to the present application being used on a feeding bottle.
Figure 2:
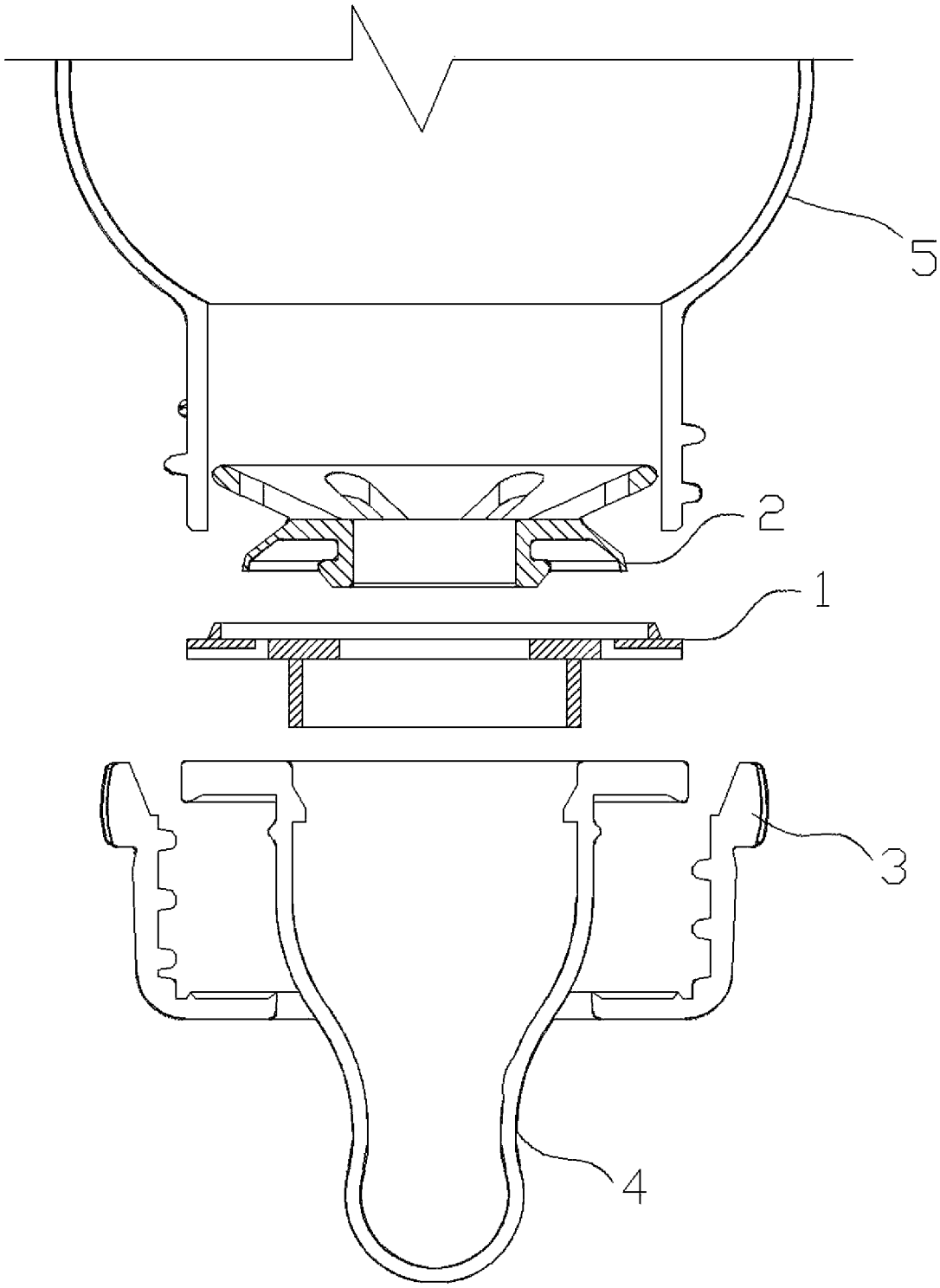
FIG. 2 is a disassembling schematic view with an embodiment according to the present application being used on the feeding bottle.

FIG. 1 and FIG. 2 are schematic views with a device according to the present embodiment being assembled to a feeding bottle, and the feeding bottle shown in the Figures is placed upside down. The present embodiment includes an air inlet plate 1, a fitting ring 2 and a capping 3, the air inlet plate 1 is fixed between a nipple body 4 and a bottle body 5 of the feeding bottle by the capping 3, and the fitting ring 2 is embedded in the air inlet plate 1.

Figure 3:
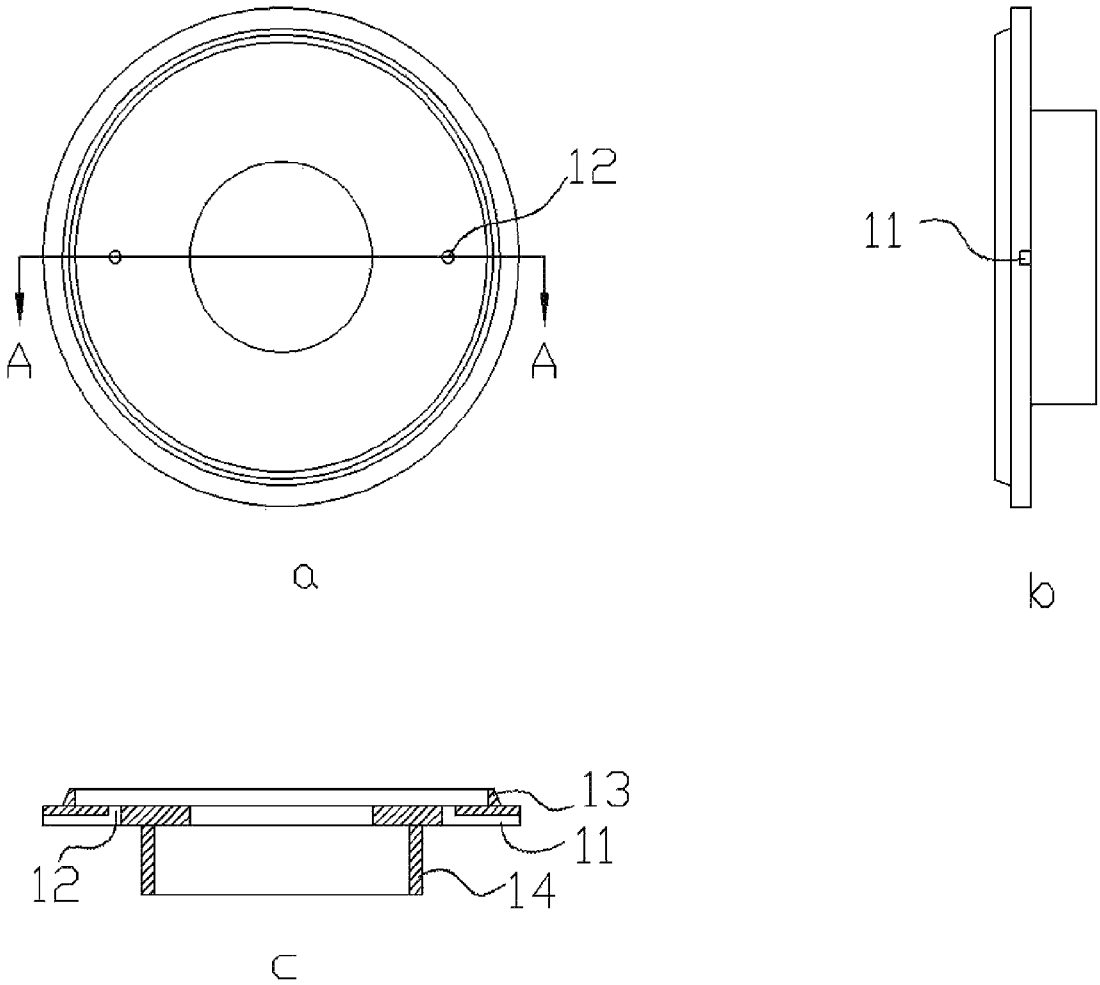
FIG. 3*a* is a front view of an air inlet plate of the embodiment according to the present application.
FIG. 3*b* is a sectional view of the FIG. 3*a* taken along the line A-A.
FIG. 3*c* is a left view of the FIG. 3*a;*

As shown in FIG. 3, FIG. 3*a* is a front view of the air inlet plate 1, FIG. 3*b* is a sectional view of the FIG. 3*a* taken along the line A-A, and FIG. 3*c* is a left view of the FIG. 3*a*.

The air inlet plate 1 is generally of a ring shape, that is, a hollow is formed at the central part thereof. The nipple body 4 passes through the central part of the capping 3. The air inlet plate 1 is provided with a ventilating hole 12, the lower portion of the air inlet plate is further provided with a ventilating groove 11, one end of the ventilating groove 11 is connected with the ventilating hole 12, and the other end of the ventilating groove 11 extends to an outer edge of the air inlet plate 1.

As shown in FIG. 3*c*, in the present application, the cross section of the ventilating groove 11 is preferably of a square shape, and may also be of a semicircular shape. In order to achieve better air return effect, the numbers of the ventilating groove 11 and the ventilating hole 12 can be increased, and there are preferably two in the present embodiment. The positions of all the ventilating grooves 11 can be distributed symmetrically or distributed unsymmetrically. Each of the ventilating holes 12 can correspond to one ventilating groove 11 or correspond to a plurality of ventilating grooves 11.

As shown in FIG. 3*c*, the air inlet plate 1 is provided with a pressing ring 14 at a lower portion, the outer diameter of the pressing ring 14 is slightly larger than the inner diameter of an opening portion of the nipple body 4, so that pressing ring 14 presses against an inner wall of the nipple body 4, thus performing a pressing action on the inner wall of the nipple body 4 and further keeping the nipple body 4 stable. The pressing ring 14 and the capping 3 cooperate with each other, so that both the inner wall and the outer wall of the nipple body 4 can be pressed tightly, thereby it is not easy for the nipple body 4 to fall out from the bottle body 5.

As shown in FIG. 3*c*, the air inlet plate 1 is provided with a retaining ring 13 on the side close to the bottle body 5, preferably, the outer diameter of the retaining ring 13 is equal to or less than the inner diameter of an opening portion of the bottle body 5, with difference within 3 mm. The retaining ring 13 of the air inlet plate 1 seizes the edge of the opening portion of the feeding bottle, so as to perform the effect of positioning and preventing leakage.

Figure 4:
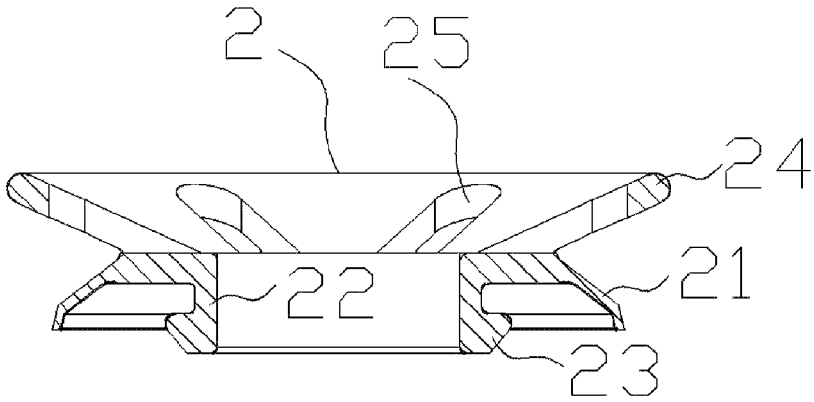
FIG. 4 is a sectional view of a fitting ring of the embodiment according to the present application.

As shown in FIG. 4, which is a sectional view of the fitting ring 2 according to the present embodiment, the fitting ring 2 is generally of a ring shape, the outer portion of the fitting ring 2 has a closing cap 21 and an air dispersing cap 24. The air dispersing cap 24 is provided with air dispersing holes 25, the air dispersing holes 25 have the same size and are arranged evenly, preferably, there are six air dispersing holes 25 and they are arranged evenly about the symmetry axis of the fitting ring 2. The fitting ring 2 is provided with a neck portion at an inner portion, an end of the neck portion 22 that closes to the nipple body 4 is provided with a snap portion 23 which is used for snapping the air inlet plate 1.

Figure 5:
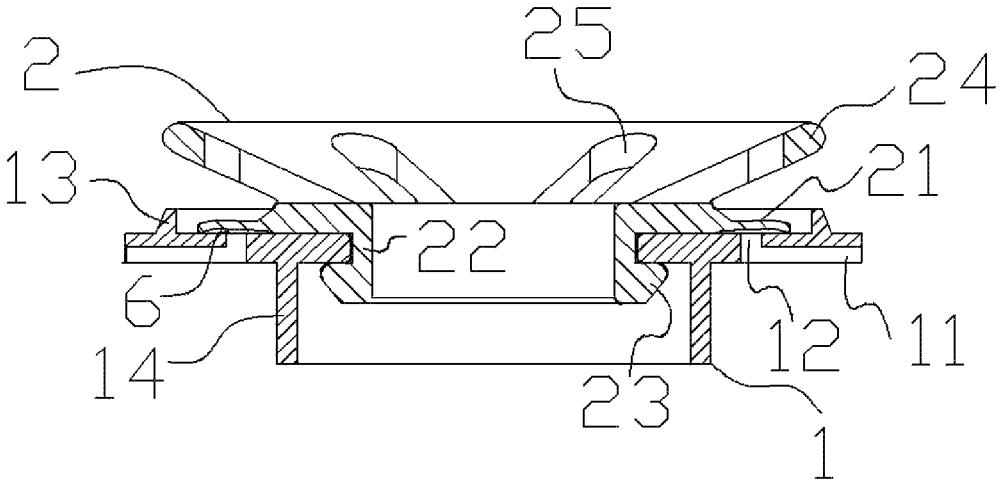
FIG. 5 is a view with the air inlet plate and the fitting ring of the embodiment according to the present application being fitted.

As shown in FIG. 5, which is a view with the air inlet plate 1 and the fitting ring 2 according to the present embodiment being fitted, the air inlet plate 1 and the fitting ring 2 are embedded together, and the closing cap 21 covers the ventilating hole 12 so as to form a closed air return space 6.

Taking FIG. 1, FIG. 3, FIG. 4 and FIG. 5 into consideration together, the air dispersing cap 24, the closing cap 21 and the bottle body 5 enclose an air dispersing space 26. During air return, the air passes through the ventilating groove 11 and the ventilating hole 12 of the air inlet plate 1, reaches to the air return space 6 enclosed by the closing cap 21 of the fitting ring 2 and the air inlet plate 1, and then goes into the air dispersing space 26 through a gap between the fitting ring 2 and the air inlet plate 1, finally, is distributed to the inside of the bottle body 5 through the air dispersing holes 25 arranged evenly on the air dispersing cap 24 of the fitting ring 2, so as to achieve a steady air return. Therefore, the milk can be fed steadily, thus avoiding the baby being choked by milk due to rapid air return.

The air return space 6 has gaps formed by fitting the air inlet plate 1 and the fitting ring 2 together on both the inner portion and the outer portion. When the feeding bottle is not in use and the air return is not desirable, the gaps is closed, thus forming a closed air return space 6, and the outlet of the ventilating hole that is located at the side close to the bottle body 5 is located inside the air return space 6. Thus it is possible to insure that the milk will not leak out through the ventilating hole 12 and the ventilating groove 11 when the air return is not performed.

The air inlet plate 1 and the fitting ring 2 are made of soft material, the air inlet plate 1 is preferably made of polypropylene (simply referred to as PP) or polycarbonate (simply referred to as PC) or thermoplastic elastomer (TPE), and the fitting ring 2 is preferably made of silicone. After the air inlet plate 1 and the fitting ring 2 are fitted, the closing cap 21 of the fitting ring 2 will generate a significant deformation, thus forming air return space 6 between the fitting ring 2 and the air inlet plate 1. The air return space 6 communicates with the outside atmosphere through the ventilating hole 12 and the ventilating groove 11 and communicates with the space inside the feeding bottle through the gaps formed by fitting the air inlet plate 1 and the fitting ring 2 together.

As compared with the prior art, the present embodiment is provided with the air inlet plate 1, that is a fixing and connecting component is further provided between the nipple body 4 and the bottle body 5, the nipple body 4 and the bottle body 5 have the fixing and connecting component not only at the outer walls, that is the capping 3, but also at the inner walls, that is the air inlet plate 1, they are fixed and connected in two directions from the outer walls and the inner walls, so that the nipple body 4 can be steadily connected to the bottle body 5.

Moreover, the present embodiment is further provided with the fitting ring 2, since the air inlet plate 1 is provided with the ventilating groove 11, after the nipple body 4 is fixed by the capping 3, the ventilating groove 11 still can communicate with the outside atmosphere, the outside atmosphere can go into the air return space 6. The fitting ring 2 can separate the outside atmosphere from the space inside the bottle body 5, and when there is a negative pressure inside the bottle body 5 the air return effect can be generated, when the pressure inside the bottle body 5 is normal it is possible to insure that the milk inside the bottle body 5 is prevented from leaking out through the ventilating groove 11 and the ventilating hole 12. by the air inlet plate 1 and the fitting ring 2 cooperating with each other, in the process of baby sucking out milk, the milk will flows out from the nipple body 4 and a negative pressure will be generated inside the bottle body 5, thereby, the outside atmosphere sequentially passes through the ventilating groove 11 and the ventilating hole 12, reaches to the air return space 6, and then goes into the bottle body 5 through the gaps formed by fitting the air inlet plate 1 and the fitting ring 2 together, thus achieving air return. When the milk is not sucked out by the baby, if the feeding bottle is placed upside down, since there is no negative pressure inside the bottle body 5, the air pressure inside the bottle body 5 is sufficient to tightly close the air inlet plate 1 and the fitting ring 2, thus the milk will not leak out from the ventilating hole. The present embodiment can achieve the effect of automatic air return, the structure of which is simple, the air return effect is better, and the air inlet plate 1 and the fitting ring 2 functioning to air return are easy to clean after being disassembled.

Furthermore, for existing common feeding bottle, the air inlet plate 1 and the fitting ring 2 according to the present embodiment can be conveniently mounted thereon, thus it can be converted into a feeding bottle preventing the nipple from falling out and with the air return function, on the basis of which the automatic air return function of the feeding bottle can be achieved, thus improving the utilization of raw material and achieving economy and environmental protection effect.

The embodiment described above is only one embodiment of the present application and the description of which is relatively specific and detailed, which should not be considered as limitations to the scope of the present application. It should be noted that, those skilled in the art may make various improvements and modifications to the present application without departing from the concept of the present application, and these improvements and modifications should also fall into the protection scopes of the claims of the present application. Therefore the scope of protection of the present application should be defined by the claims.

What is claimed is:

1. A feeding bottle preventing a nipple from falling out and with an air return function comprising a nipple body and a bottle body, wherein the feeding bottle further comprises an air inlet plate and a capping, and the air inlet plate is fixed between the nipple body and the bottle body by the capping, wherein the air inlet plate is provided with a ventilating hole and a ventilating groove, one end of the ventilating groove being directly attached to and communicated with the ventilating hole and another end of the ventilating groove being extended to an outer edge of the air inlet plate; the feeding bottle further comprising a fitting ring mounted on a bottle-engaging side of the air inlet plate facing the bottle body, the ventilating groove of the air inlet plate and a contacting surface of the nipple body cooperate with each other and form a unidirectional air inlet passage, wherein the air inlet plate and the fitting ring are fitted together so that a deformable bulging annular closing cap is formed on a peripheral portion of the fitting ring to completely close the ventilating hole and form a closed annular air return space, wherein the deformable bulging annular closing cap deforms inwards towards an interior of the bottle body to thereby open the ventilation hole and allow air to return into the bottle body.

2. The feeding bottle preventing the nipple from falling out and with the air return function according to claim 1, wherein the air inlet plate is provided with a tubular pressing ring, and the tubular pressing ring presses against and exerts a radial outward force on an inner tubular surface of the nipple body.

3. The feeding bottle preventing the nipple from falling out and with the air return function according to claim 2, wherein the air inlet plate is provided with a retaining ring on the side close to the bottle body, and the outer diameter of the retaining ring is equal to the inner diameter of an opening portion of the feeding bottle.

4. The feeding bottle preventing the nipple from falling out and with the air return function according to claim 2, wherein the air inlet plate is provided with a retaining ring on the side close to the bottle body, and the outer diameter of the retaining ring is less than the inner diameter of an opening portion of the feeding bottle.

5. The feeding bottle preventing the nipple from falling out and with the air return function according to claim 1, wherein an inner portion of the fitting ring is provided with a neck portion, and the air inlet plate is sleeved outside the neck portion.

6. The feeding bottle preventing the nipple from falling out and with the air return function according to claim 5, wherein an end of the neck portion close to the nipple is provided with a ring shaped snap portion being able to snap the air inlet plate.

7. The feeding bottle preventing the nipple from falling out and with the air return function according to claim 1, wherein an outer portion of the fitting ring is further provided with a ring shaped air dispersing cap, the air dispersing cap is provided with air dispersing holes, and the air dispersing cap, the closing cap, and the bottle body enclose an air dispersing space.

* * * * *